United States Patent [19]

Arroyo et al.

[11] 4,284,842

[45] Aug. 18, 1981

[54] CABLE HAVING SUPERIOR RESISTANCE TO FLAME SPREAD AND SMOKE EVOLUTION

[75] Inventors: Candido J. Arroyo, Lilburn; Nicholas J. Cogelia, Duluth; Ralph J. Darsey, Lawrenceville, all of Ga.

[73] Assignees: Bell Telephone Laboratories, Inc., Murray Hill, N.J.; Western Electric Company, Inc., New York, N.Y.

[21] Appl. No.: 89,788

[22] Filed: Oct. 31, 1979

[51] Int. Cl.[3] ..... H01B 7/34

[52] U.S. Cl. ..... 174/107; 174/102 D; 174/109; 174/110 FC; 174/121 A

[58] Field of Search ..... 174/121 A, 107, 102 D, 174/109, 108, 112, 110 N

[56] References Cited

U.S. PATENT DOCUMENTS

| | | | |
|---|---|---|---|
| 2,009,004 | 7/1935 | Schatzel | 174/112 X |
| 2,135,985 | 11/1938 | Mitchell | 174/108 |
| 2,603,684 | 7/1952 | Holmes | 174/102 D X |
| 3,425,865 | 2/1967 | Schelton | 174/120 |
| 3,484,532 | 12/1969 | Anderson | 174/108 X |
| 3,509,269 | 4/1970 | Elliott | 174/107 X |
| 3,551,586 | 12/1970 | Dembiak | 174/112 X |
| 3,692,924 | 9/1972 | Nye | 174/110 N X |
| 3,903,354 | 9/1975 | Dageforde | 174/107 |
| 4,064,359 | 12/1977 | Peterson | 174/107 |
| 4,134,953 | 1/1979 | Dembiak | 174/107 X |
| 4,150,249 | 4/1979 | Pedersen | 174/107 X |
| 4,151,366 | 4/1979 | Betts | 174/116 |
| 4,154,976 | 5/1979 | Brorein | 174/115 |

*Primary Examiner*—Richard R. Kucia
*Attorney, Agent, or Firm*—E. W. Somers

[57] ABSTRACT

A cable (20) specially suited for use in building plenums because of its low flame spread and smoke evolution includes a multiconductor core (22) which is enclosed in a sheath comprising an inorganic, cellular core wrap (31), a corrugated metallic barrier (40) and dual layers (51) and (52) of a polyimide tape which are wrapped helically about the barrier in a manner that avoids a compression of the core wrap. The sheath is effective to resist heat transfer inwardly toward the core by conduction while the metallic barrier reflects radiant heat. Advantageously, the sheath containerizes the core without unduly compressing it and thereby allows the intumescence of conductor insulation during a fire to form char which is effective to suppress the evolution of smoke and the propagation of flame.

15 Claims, 5 Drawing Figures

CABLE HAVING SUPERIOR RESISTANCE TO FLAME SPREAD AND SMOKE EVOLUTION

TECHNICAL FIELD

This invention relates to a cable having superior resistance to flame spread and smoke evolution, and, more particularly, to a cable which because it has superior resistance to flame spread and smoke evolution is ideally suited for telecommunications use in building plenums.

BACKGROUND OF THE INVENTION

In the construction of many buildings, a finished ceiling, which is referred to as a drop ceiling, is spaced below a structural floor panel that is constructed of concrete, for example. The drop ceiling supports light fixtures and other ceiling-mounted items, while the space between the ceiling and the structural floor from which it is suspended serves as a return-air plenum for elements of heating and cooling systems as well as a convenient location for the installation of communications, computer and alarm system cables. It is not uncommon for these plenums to be continuous throughout the length and width of each floor.

When a fire occurs in an area between a floor and a drop ceiling thereabove, it may be contained by walls and other building elements which enclose that area. However, when and if the fire reaches the plenum, and if flammable material occupies the plenum, the fire can spread quickly through an entire story of the building and smoke can be conveyed through the plenum to adjacent areas. The fire could travel along the length of communications cables which are installed in the plenum and which comprise a plurality of conductors individually insulated with a plastic material and enclosed in a jacket comprising a plastic material.

Because of the possibility of such a flame spread and smoke evolution, particularly when aided by flammable insulation of cables, the 1975 edition of the National Electric Code (NEC) prohibited the use of electrical cables in plenums unless they were enclosed in metal conduits. Since rigid metal conduits are difficult to route in plenums congested with other items, a rearrangement of office telephones which in some companies has almost become an annual event, is extremely expensive. However, the code permits certain exceptions to this cost prohibitive requirement. For example, flame-resistant, low smoke producing cables without metallic conduit would be permitted provided that such cables were tested and approved by an authority such as the well known Underwriters Laboratories. What is needed is a cable for use in buildings which is relatively inexpensive to manufacture, but which meets the NEC requirements for flame retardance and smoke evolution, and which has excellent mechanical properties, particularly mechanical flexibility.

In the marketplace, cable which comprises a core having a paper core wrap and enclosed in a relatively thick metallic shield is available, but it is relatively inflexible and somewhat difficult to maneuver in plenums. Moreover, care must be taken during installation to guard against possible electrical shock which may be caused by the metallic sheath of the above-described cable engaging exposed electrical service wires or equipment in a plenum. Also, while the above-described cable meets flame spread requirements of the code, the snugness with which the metallic shield encloses the conductors prevents a charing of the conductor insulation that could effectively seal off a portion of the cable about the flame and reduce the evolution of smoke. One commercially available plastic material has been accepted as the covering material for plenum cable without the use of metal conduit, but it is relatively expensive and is difficult to process. The prior art also includes U.S. Pat. No. 3,425,865 which shows an electrical conductor covered successively with an inorganic, substantially flame-resistant material such as, for example, woven glass tape, a polyimide layer and a protective polyimide type braid coated with a polyimide finisher as an outer layer.

What is needed and what is not provided by prior art products is a cable which is covered with a material which is flame resistant and which has low smoke evolution. The sought after cable desirably is less costly than that of presently available products, is easy to process, and is available in sufficient quantities to satisfy escalating demands.

SUMMARY OF THE INVENTION

The foregoing problems of providing a cable that has superior resistance to flame spread and smoke evolution, that is attractively priced, and that is relatively simple to manufacture are overcome by the cable of this invention. The cable includes a core having at least one insulated conductor and a sheath which comprises a layer that is made of an inorganic, cellular material and that encloses the core, and a metallic barrier having longitudinal edge portions that form a seam. In order to be able to reflect radiant heat outwardly, an outwardly facing major surface of the metallic barrier has an emissivity in the range of about 0.039 to 0.057. The metallic barrier is covered with an inner tape comprising a thermosetting material having at least translucent optical clarity and having a relatively low thermal diffusivity which in a preferred embodiment is in the range of about 0.0008 to 0.001 $cm^2/sec.$, and a second tape which is identical to the inner tape. The inner and the outer tapes are wrapped about the metallic barrier to form overlapped seams which are sealed.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 2:
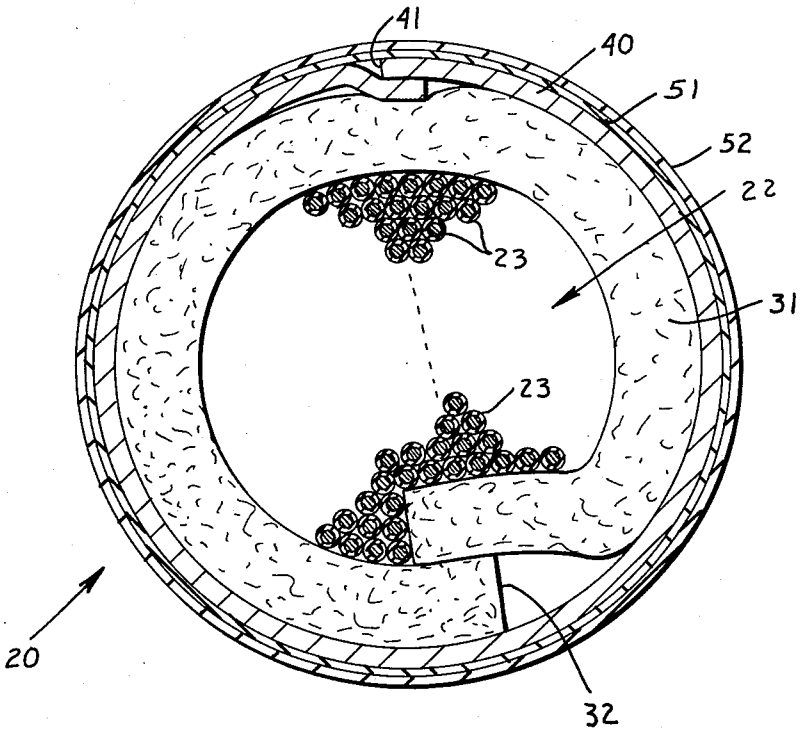
FIGS. 1 and 2 are perspective and end views of a cable in accordance with this invention and which has superior flame and smoke retardance properties with overlapped seams in FIG. 2 exaggerated for purposes of clarity.
Figure 1:
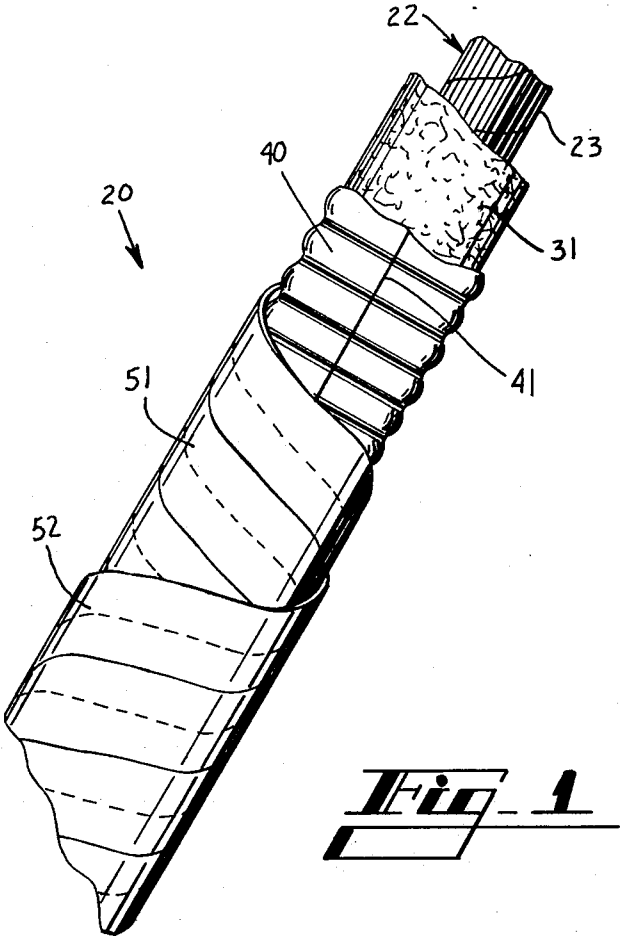

Referring now to FIG. 1, there is shown a communications cable, which is designed generally by the numeral 20, which includes a core 22 having a plurality of individually insulated conductors 23—23. Generally, the insulation which covers each of the conductors of the core is a somewhat flame retardant plastic material such as, for example, polyvinyl chloride (PVC). The core 22 typically includes a number of insulated conductor pairs, e.g. two to twenty-five pairs, which is relatively low compared to the number included in a stub cable which services a building. However, the core 22 could be one which is suitable for use in computer and alarm signalling networks.

Figure 3:
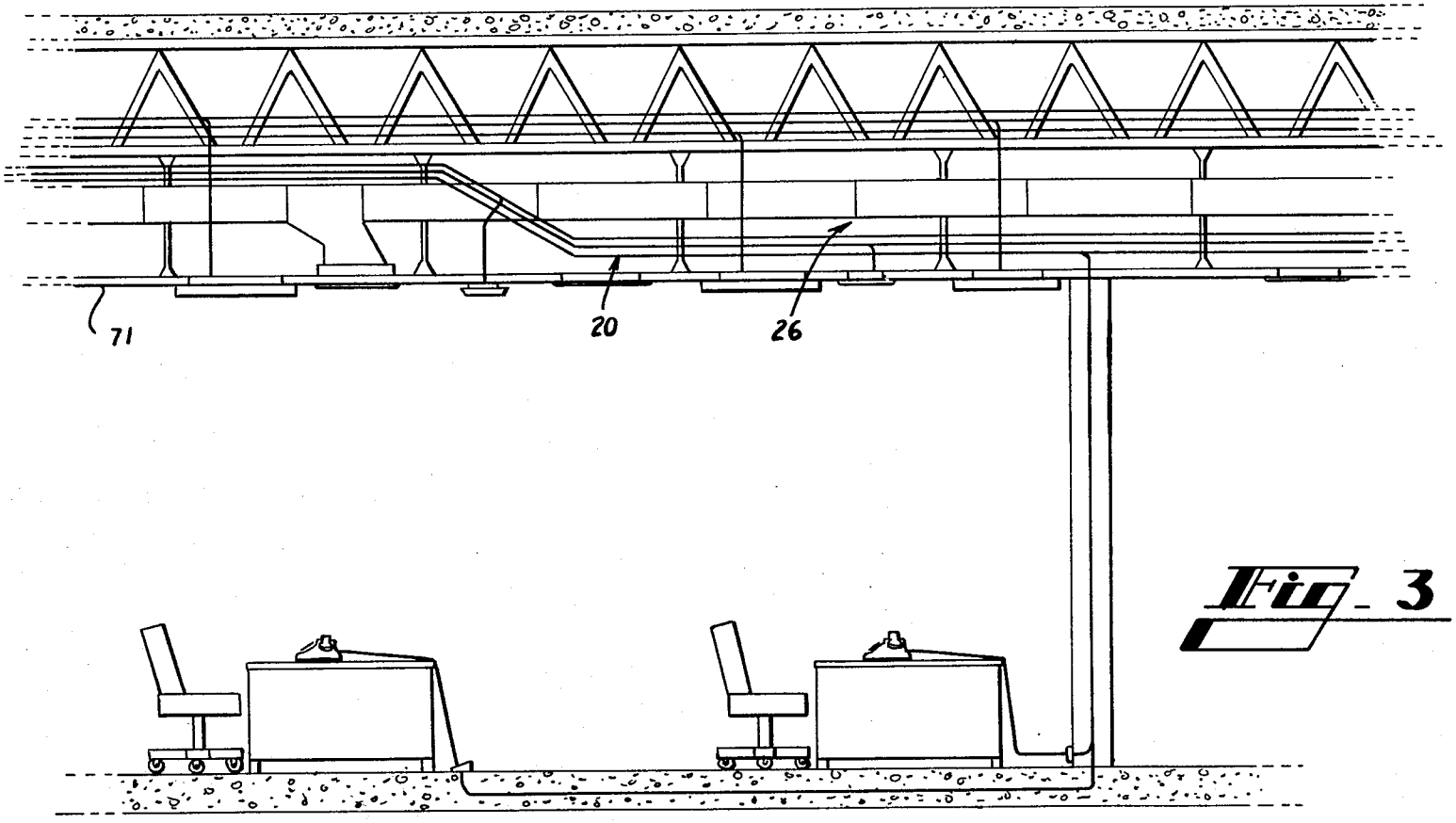
FIG. 3 is an elevational view of a portion of a building to show an environment in which the cable of this invention may be used.

As will become apparent from test results disclosed hereinafter, the cable 20 of this invention satisfies a long felt need for a cable which is specially suited for use in a building plenum 26 (see FIG. 3). Such a cable must meet stringent current requirements for flame spread and smoke evolution as well as the mechanical and electrical safety properties of a cable used in such an environment.

The use of a cable which comprises the core 22 and only a PVC jacket does not exhibit what are now totally acceptable flame spread and smoke evolution properties. For example, in a well known Steiner tunnel test in accordance with A.S.T.M. E84 modified for communications cables, as the jacket temperature in such a cable rises, gaseous pyrolysis products evolve, and charring of the jacket material begins, after which, the PVC conductor insulation begins to decompose and char. If the jacket char retained its integrity, it could function to insulate the substrate, but in this simple PVC jacketed cable, it is ruptured by the expanding PVC insulation char, exposing the virgin interior of the PVC jacket and insulation to elevated temperatures. The jacket as well as the restricted insulation char begin to pyrolize and emit flammable gases. These gases ignite and by convection burn beyond the area of flame impingement, propagating flame and evolving smoke.

Turning again to the cable 20 of this invention, a sheath construction which encloses the core 22 and which overcomes the aforementioned problems to provide excellent flame and smoke retardation is shown in FIG. 1. Moving outwardly from the core 22, it is seen that the cable 20 includes a layer 31 which is resilient so that it is capable of being compressed by the PVC insulation when it intumesces and expands under application of heat. It has been found that a material which is an inorganic, non-woven cellular material such as, for example, a Fiberglas® tape material is suitable for the layer 31. Preferably, the diameter of the fibers in the material which comprises the layer 31 is not less than 6 microns. The Fiberglas® tape is wrapped about the core 22 to form a longitudinal overlapped seam 32 of about 0.64 cm which is maintained by a fire resistant binder 33 made from a material such as Fiberglas®; however, a binder which is made of a polyester material is also suitable. The heat resistance property of the Fiberglas® tape layer 31 is enhanced because of its cellular structure. While in the preferred embodiment the layer 31 is wrapped to form a longitudinal seam, the Fiberglas® tape could be wrapped helically about the core 22.

The cable system 20 also includes a metallic strip which is formed into a barrier 40 that encloses the layer 31. For purposes of heat reflection, at least one major surface of the strip has an emissivity in the range of about 0.039 to 0.057. In order to provide the cable 20 with flexibility to permit workers to direct the cable along a plenum, the metallic barrier, which is preferably made of aluminum, is corrugated. The barrier 40 in a preferred embodiment is wrapped about the layered core 22 to cause the at least one major surface to face outwardly and to form a longitudinal overlapped seam 41 having nested corrugations. Not only could the barrier 40 not be corrugated but it could also be wrapped helically about the Fiberglas® tape-covered core 22. While it has been found that an aluminum strip having a thickness of only 0.003 cm could be used, preferably, the barrier 40 is made from an aluminum strip having a thickness of about 0.020 cm.

The aluminum barrier 40 effectively containerizes the core 22 and resists any compression of the layer 31 and the core. This is a desirable feature since any compression of the layer 31 would tend to destroy its cellular structure and impair its fire resistant qualities.

To provide desired thermomechanical and dielectric strengths, the outer portion of the cable system 20 includes an inner and an outer tape 51 and 52, respectively, which are made of a thermosetting polymeric material of at least translucent optical clarity having a thermal diffusivity of about 0.001 $cm^2$/sec which preferably is a polyimide material. It has been found that KAPTON® polyimide film marketed by E. I. DuPont is suitable for the tapes 51 and 52. Kapton® polyimide film is described and properties thereof disclosed in a brochure designated A62397 published by DuPont.

The inner and outer tapes 51 and 52 are helically wrapped about the barrier 40 in opposite directions with each wrap of each tape being overlapped about fifty percent of the prior wrap. The amount of overlap and the angle of wrap to the longitudinal axis of the cable 20 is a function of the line speed of the core 22. It is also within the scope of this invention to wrap the tapes 51 and 52 about the core 22 to form longitudinal seams which are offset or to form one tape with a longitudinal overlapped sealed seam and the other with a helical overlapped seam.

The overlapped seam of each of the tapes 51 and 52 must be sealed to prevent escape of gases which are generated by decomposing PVC insulation during a fire and cause those gases to be directed longitudinally along the cable. In order to accomplish this, the tapes 51 and 52 which are each about 0.0025 cm thick have an adhesive, such as, for example, TEFLON® fluorinated ethelene propylene marketed by E. I. DuPont coated on either one or both sides thereof. While the above-identified adhesive is preferred, others may suffice, but any used must not ignite prematurely, must have a melting point in the range of 250°-280° C. and must have a thermal diffusivity in the range of about 0.0008 to 0.001 $cm^2$/sec. It has been found that the tape having the adhesive coating on only one major surface exhibits a slightly better performance during a fire than one coated on both major surfaces. Moreover, the inner tape 51 is wrapped about the barrier 40 so that the adhesive is on an outwardly facing surface thereof while the outer tape is wrapped so that the adhesive faces inwardly.

Tests have shown that heat is principally transferred into the cable core 22 by thermal radiation, secondly by conduction and finally by convection. The outwardly facing major surface of the metallic barrier 40 cooperates with the dual KAPTON® tape covering to provide a reflective system. The polyimide tapes 51 and 52 are not supportive of combustion, but they are translucent to permit ultraviolet heat energy to pass through. In this way, a substantial amount of the heat passing through the polyimide tapes 51 and 52 is reflected by the metallic barrier 40 and retransmitted outwardly through the tapes. Advantageously, the metallic barrier 40 functions not only to conduct heat away from the point of conflagration, but also functions to reflect heat which has been directed inwardly through the outer covering tapes. The double wrap of KAPTON ® tape is effective to delay heat transfer by conduction through the cable 20.

The cable 20 of this invention is also characterized by its ability to inhibit the evolution of smoke. A measure of smoke evolution is termed optical density which is an obscuration measurement over a length of time as seen by an optical detector with the lower the optical density, the lower and hence the more desirable is the smoke characteristic. Typical peak optical density values are 0.38 for PVC insulated and jacketed cable in metal conduit, 0.91 for a paper-wrapped core enclosed in a non-corrugated metal shield, 0.35 for Teflon-covered cables and 0.33 to 0.46 for the cable 20 in accordance with this invention.

Figure 4:
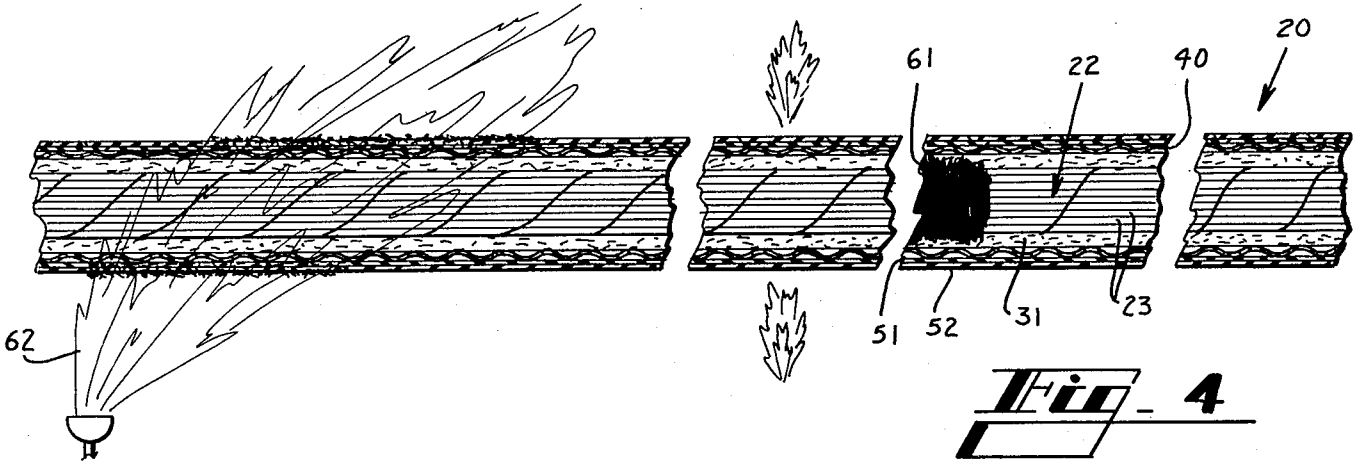
FIG. 4 is an elevational view of a portion of a length of cable being subjected to a flame in a well known test apparatus and shows the condition of the cable as a result of the exposure to the flame.

To understand the mechanism of flame spread and smoke evolution, attention is directed to FIG. 4 which represents a well known Steiner Tunnel test. The intumescent process of carbonacious charring of the PVC insulation along its outwardly facing surface acts to inhibit further degradation of the PVC by blocking internal convective air movements, and hence prevent the longitudinal travel of heated air which decomposes the insulation and causes smoke evolution. This is accomplished by the charred PVC insulation 61 effectively blocking off a section of the length of cable 20 to localize further PVC decomposition to the portion of the cable adjacent to the flame 62. In effect, the cable 20 of this invention permits the PVC plastic insulating material to do what it naturally would like to do under such fire conditions, i.e. to char.

It has been found that the tightness of the enclosure of the sheath, which comprises the Fiberglas tape 31, the metallic barrier 40 and the polyimide tapes 50 and 51 about the core, restricts the amount of char that is formed, but increases the evolution of smoke. Even if the metallic barrier 40 were to be wrapped about the core without undue compression of the core, care must also be taken when wrapping the double layer of KAPTON ® tape about the core to avoid compressing the barrier. If this precautionary measure were not taken, longitudinal edge sections of the barrier 40 would slide, thereby causing a reduction of the diameter of the barrier and a compression of the cellular layer 31, which reduces its effectiveness as a thermal barrier. Also, the PVC charring mechanism is restricted, and this leads to emission of volatile gases which might escape through the seams and ignite downstream. One way in which undue compression of the cellular layer 31 is avoided is accomplished is by controlling the amount of the overlap of the outer tape 52 over the inner tape 51. For example, in a preferred embodiment, it has been found that the outer tape shield should overlap the inner tape by about 50%.

By the use of a relatively thin shield and a double tape wrap, the cable 20 of this invention delays the conduction of heat to the core while the barrier 40 reradiates energy thereby adding to the delay. By delaying conductive heat transfer, which decomposes the conductor insulation, smoke emission and hence further flame spread is controlled. Heat penetration is further prevented by the Fiberglas ® layer 31 which is wrapped about the core 22 to form a predetermined inside diameter which allows the charred PVC to expand and block off the decomposed area. The layer 31 is sufficiently flexible so that it is capable of relaxation along with the expanding char.

The cable 20 also provides an installer with inherent protection from electrical shock. As opposed to cables which are enclosed in exposed metallic sheaths and which could engage other electrical equipment in plenums during installation as an installer pushes a length of cable from an opening in a ceiling 71 (see FIG. 3), the metallic barrier 40 of the cable 20 of the present invention is not exposed.

Figure 5:
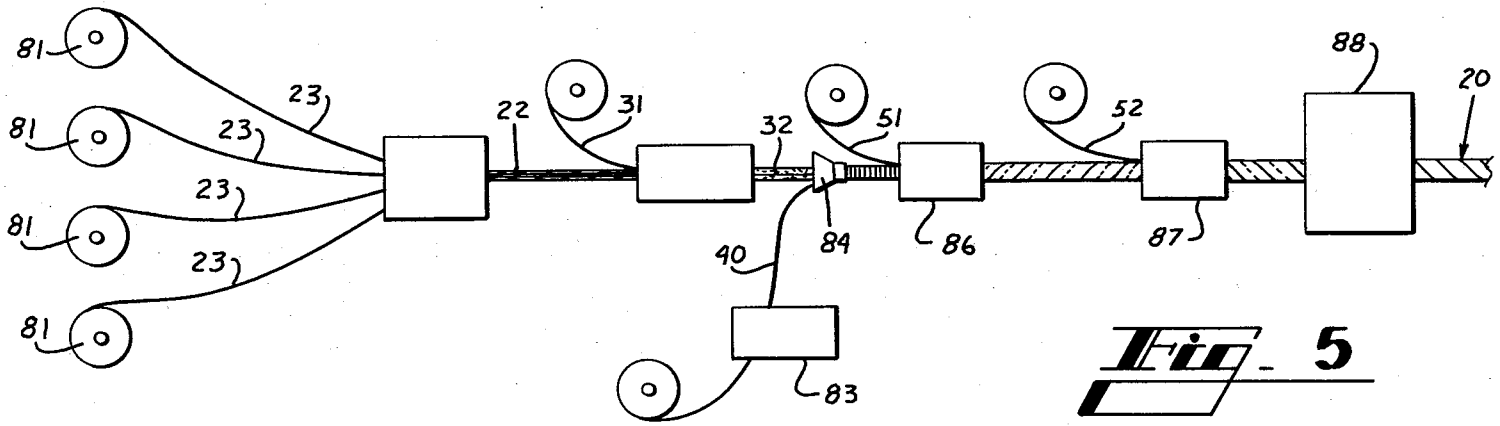
FIG. 5 is a schematic view of a manufacturing line for manufacturing the cable of FIG. 1 of this invention.

In a method of making the cable 20, a plurality of twisted pairs of the conductors 23—23 are moved from reels 81—81 (FIG. 5) and through apparatus which forms the pairs into the core 22. The core 22 is advanced along a manufacturing line and is enclosed by the Fiberglas ® tape 31 which is wrapped longitudinally about the core by apparatus which is well known in the industry. Then a metallic strip 40 of aluminum which has been corrugated by a standard corrugating apparatus 83 is directed inwardly toward a forming apparatus 84 such as that disclosed for example, in K. P. Trusch U.S. Pat. No. 4,100,003 issued July 11, 1978, which forms the strip into a tube having an overlapped seam. Finally, the barrier enclosed core 22 is advanced through devices 86 and 87 which wrap polyimide tapes 51 and 52 about the barrier 40 and then through apparatus 88 which heats the tapes to cause the adhesive coating to bond together the overlapping portions.

EXAMPLE

A core comprising twenty-five pairs of 24 gauge copper conductors individually insulated with a polyvinyl chloride insulation having a thickness of about 0.015 cm is advanced through the apparatus 100 at a line speed of about 12 meters/minute which first applies a Fiberglas ® tape having a thickness of 0.076 cm and a width of 3.81 cm about the core to form a longitudinal overlapped seam with an overlap of about 0.64 cm. A typical Fiberglas ® tape is Manniglas 1200 made by the Manning Paper Company and having a weight of about 66 grams/square meter. The non-woven glass layer 31 has a thermal diffusivity of 0.023 $cm^2$/sec and an average fiber diameter of about 6.35 microns. Then an aluminum tape having a thickness of about 0.020 cm and a width of about 2.54 cm is corrugated to have 3.54 corrugations per centimeter, each corrugation being about 0.076 cm deep, and wrapped about the Fiberglas tape - enclosed core with a longitudinally extending seam having an overlap of about 0.64 cm.

Subsequently, an inner tape made of a polyimide material, specifically DuPont's KAPTON ® "F" tape, having a thickness of about 0.0025 cm and a width of about 2.54 cm is wrapped helically about the core such that each turn is overlapped about 50% of the prior turn. KAPTON ® polyimide has a a thermal diffusivity of 0.001 $cm^2$/sec and a refractive index of 1.78. A second KAPTON ® polyimide tape having the same width and thickness as the first tape is wrapped helically in an opposite direction about the first tape.

Each of the KAPTON ® tapes has an inwardly facing surface coated with about 0.013 cm of a TEFLON ® (tetrafluoroethylene hexafluoropropylene copolymer) fluorinated ethylene propylene adhesive marketed by DuPont. TEFLON FEP has a thermal diffusivity of 0.001 $cm^2$/sec and a melting point in the range of 253° to 282° C. After the tapes have been wrapped about the core, the cable 20 is advanced through an oven having a temperature of about 593° C. which causes the adhesive to soften and to bond together the tapes along the overlaps of their turns.

A group of twenty-four cables 20—20 of this example and each having twenty-five pairs of insulated conductors were subjected to tests in a Steiner Tunnel in accordance with A.S.T.M. E84 modified for communications cables and exposed to the temperatures of 904° C. or incident heat fluxes as high as 6.3 watts/cm$^2$. Cables (1)–(4) having other constructions were also tested and the results are tabulated below in Table I with cable (5) being the cable 20 of this invention.

TABLE I

| | Core Wrap | Insulation | No. Cables | Flame Spread (Ft) | Peak Optical Density |
|---|---|---|---|---|---|
| (1) Standard Inside Wiring PVC Jacket | None | PVC | 24 | 14 | 3.0 |
| (2) Aluminum | Paper | PVC | 10 | 3.5 | 0.91 |
| (3) PVC Jacket in Conduit | | PVC | 10 | 3.0 | 0.30 |
| (4) TEFLON® FEP Plastic | Glass | TEFLON-FEP Plastic | 18 | 3.0 | 0.35 |
| (5) KAPTON® Tapes Plus 0.020 cm Aluminum | Glass | PVC | 24 | 4.5 | 0.33 |

As can be seen from Table I, the cable 20 of this invention has properties which compare favorably with the PVC cable in a metal conduit and the TEFLON® - FEP jacketed cable. The significance of the fully developed char can be highlighted by the results of Steiner Tunnel test results on a general trade product designated cable (2) in Table I. The aluminum jacket provides a tight fitting excellent radiative barrier around the core. However, the PVC char formation is restricted, the pyrolysis gas pressure buildup is clearly evident by voluminous amounts of smoke being emitted at high velocities at both ends of the cable.

The cable 20 of this invention (a) eliminates premature ignition at the overlapped seams; (b) delays the transfer of conducted heat to the core 22 as Table I and FIG. 4 illustrate; (c) effectively reradiates the radiant energy present throughout the length of the UL Steiner Tunnel; (d) results in a thermal delay which produces less PVC insulation deterioration which in turn produces less smoke and therefore less flame spread; and (e) by holding the aluminum to 1.016 to 1.27 cm inside diameter, the PVC insulation is allowed to char fully thereby blocking convective pyrolysis gas flow along the cable length as illustrated in FIG. 4.

It is to be understood that the above-described arrangements are simply illustrative of the invention. Other arrangements may be devised by those skilled in the art which will embody the principles of the invention and fall within the spirit and scope thereof.

What is claimed is:

1. A cable which resists flame spread and smoke evolution, said cable comprising:

a core which includes an insulated conductor;

a layer which encloses the core and which comprises an inorganic, cellular material;

a metallic barrier which encloses said cellular layer and which comprises a strip having longitudinal edge portions formed into a seam, said metallic barrier having an outwardly facing surface which has a relatively low emissivity; and an outer cover of a flame retardant material which encloses said metallic barrier and which comprises:

a first tape comprising a thermosetting material having at least translucent optical clarity and having a relatively low thermal diffusivity, said first tape wrapped about the barrier with an overlapped sealed seam; and a second tape comprising a thermosetting material having at least translucent optical clarity and having a relatively low thermal diffusivity, said second tape wrapped about said first tape with an overlapped sealed seam.

2. The cable of claim 1, wherein said layer of inorganic, cellular material which encloses the core is capable of being compressed to allow expansion of the insulation of the conductors when said insulation intumesces when exposed to heat.

3. The cable of claim 1, wherein said layer of inorganic, cellular material is wrapped about the core to form a longitudinal overlapped seam.

4. The cable of claim 1, wherein said cellular layer comprises a glass based tape with the diameter of each fiber being not less than six microns.

5. The cable of claim 1, wherein said barrier is formed from a corrugated aluminum tape.

6. The cable of claim 1, wherein said metallic barrier and said first and second tapes of said outer cover are disposed about said cellular layer without substantial compression of said barrier to preserve the cellular structure of said cellular layer.

7. The cable of claim 1, wherein said metallic barrier is wrapped about said core to form a longitudinal overlapped unsealed seam.

8. The cable of claim 1, wherein said outwardly facing surface of said metallic barrier has an emissivity in the range of about 0.039 to 0.057.

9. The cable of claim 1, wherein the thermal diffusivity of each of said tapes is in the range of about 0.0008 to 0.001 cm$^2$/sec.

10. The cable of claim 1, wherein each said tape is wrapped helically about the enclosed core so that each turn of said each tape overlaps at least about fifty percent of a preceding turn of the same said tape.

11. The cable of claim 10, wherein said first and said second tapes are made of a polyimide plastic material.

12. The cable of claim 1 wherein each of said tapes has at least a portion of at least one major surface coated with an adhesive that seals the seam and does not burn prematurely.

13. The cable of claim 12, wherein an outwardly facing surface of said first tape is coated with an adhesive and an inwardly facing surface of said second tape is coated with an adhesive.

14. The cable of claim 13, wherein the thermal diffusivity of said adhesive is in the range of about 0.0008 to 0.001 cm$^2$/sec.

15. The cable of claim 8, wherein said first and second tapes have at least a portion of at least one major surface coated with a fluorinated ethylene propylene adhesive.

* * * * *